United States Patent [19]

Credelle

[11] 4,103,204

[45] Jul. 25, 1978

[54] FLAT DISPLAY DEVICE WITH BEAM GUIDE

[75] Inventor: Thomas Lloyd Credelle, East Windsor, N.J.

[73] Assignee: RCA Corporation, New York, N.Y.

[21] Appl. No.: 607,490

[22] Filed: Aug. 25, 1975

[51] Int. Cl.[2] ..... H01J 29/72; H01J 31/00

[52] U.S. Cl. ..... 313/422; 315/366

[58] Field of Search ..... 313/422; 315/366

[56] References Cited

U.S. PATENT DOCUMENTS

| | | | |
|---|---|---|---|
| 2,858,464 | 10/1958 | Roberts | 313/422 X |
| 2,928,014 | 3/1960 | Aiken et al. | 313/422 |

*Primary Examiner*—Robert Segal

*Attorney, Agent, or Firm*—Glenn H. Bruestle; Donald S. Cohen

[57] ABSTRACT

An evacuated envelope has a rectangular display section and a gun section at one side of the display section. The display section includes rectangular front and back walls in closely spaced, substantially parallel relation, and a plurality of spaced, substantially parallel support walls between the front and back walls forming a plurality of parallel channels. The gun section extends across one end of the channels and includes gun structure which will selectively direct one or more electron beams along each of the channels. In each of the channels is a beam guide which utilizes "slalom focusing" to confine each electron beam in the channel and guide the beam along the length of the channel wherein the electron beam is confined to an undulating path along the channel. The beam guide also permits selective deflection of the electron beam out of the guide toward a phosphor screen on the inner surface of the front wall.

29 Claims, 11 Drawing Figures

FLAT DISPLAY DEVICE WITH BEAM GUIDE

BACKGROUND OF THE INVENTION

The present invention relates to a flat display device including means for scanning an electron beam over the image screen thereof, and particularly to such a device including a guide structure for confining and guiding the beam and for selectively extracting the beam from the guide.

Cathodoluminescent display devices which are presently used commercially, such as the display devices for television, generally include a neck and funnel extending perpendicularly from the screen and are thus relatively deep in the dimension perpendicular to the screen.

It has long been a desire to reduce the depth or thickness of such display devices to provide a substantially flat display device. As shown in U.S. Pat. No. 2,928,014 to W. R. Aiken et al, issued Mar. 8, 1960 entitled "Electronic Device Cathode Ray Tubes", one structure which has been proposed involves a guided beam approach which comprises a thin box-like envelope with one of the large surfaces thereof constituting a faceplate on which a phosphor screen is disposed. An electron gun is provided at one side of the screen, generally at one corner, and is arranged so as to direct a beam of electrons across the device in a path substantially parallel to the screen. Deflection elements are provided to selectively deflect the beam onto successive points of the screen to achieve the desired scanning thereof. The deflection elements are generally in the form of metal film electrodes coated on the back surface and on the sides of the tube.

In using the guided beam technique a problem has arisen in making flat display tubes having large area screens, such as screens which are about 30 inches by 40 inches. For such large size devices some type of internal support structure is required to prevent the evacuated envelope from collapsing. In a device having an internal support structure, the confinement and guiding of the electron beam is more critical than in a device which has no such supporting structure so as to prevent the supporting structure from interfering with the proper scanning of the beam along the screen. Also, in the guided beam flat display devices of the type shown in U.S. Pat. No. 2,928,014, high voltages have been needed to deflect the electron beam. It would be desirable to have such a display device which operates at lower voltages and still achieves satisfactory confinement and guidance of the beam.

SUMMARY OF THE INVENTION

A flat picture display device includes an evacuated envelope having a front wall and a phosphor screen along the inner surface of the front wall. In the device is means for generating one or more beams of electrons and directing each beam in a path generally parallel to and across the front wall. Means are along the beam path for causing the beam to travel in a substantially confined undulating path but permitting the beam to be deflected out of the path toward the phosphor screen at various selected points along the path.

FIGS. *2a* and *2b* are schematic views of one form of the beam guide of the present invention and illustrating how it operates.

FIGS. *3a*, *3b* and *3c* are schematic views of another form of the beam guide of the present invention and illustrating how it operates.

Figure 1:
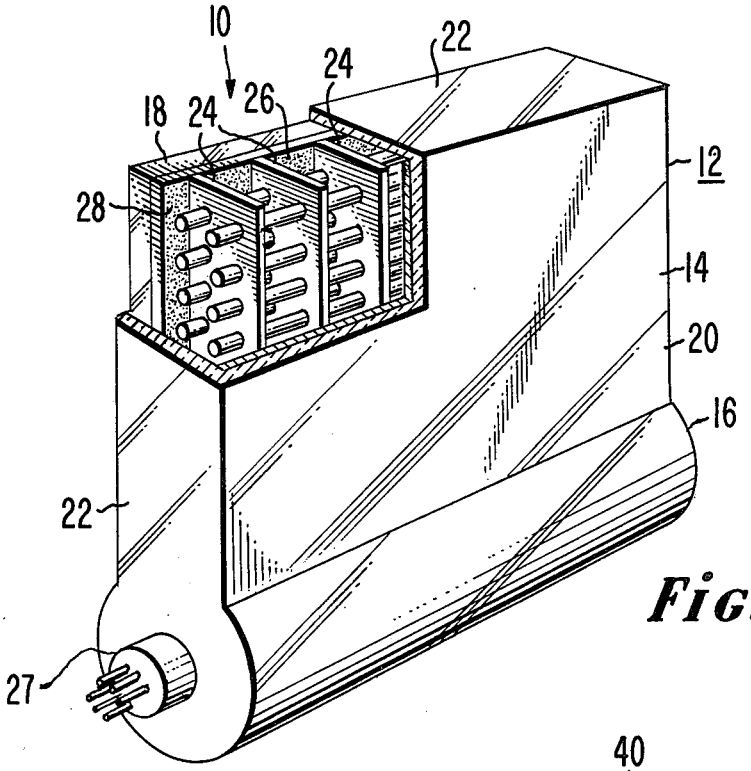
FIG. 1 is a perspective view, partially cut away, of a flat display device which includes the beam guide of the present invention.
Figure 4:
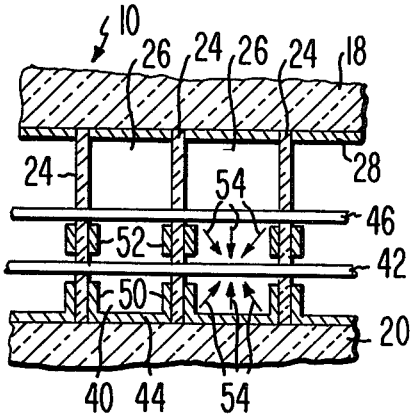

FIG. 4 is a transverse sectional view of a portion of the display device of FIG. 1 looking down the channels in the device and showing one form of the beam guide of the present invention.

Figure 5:
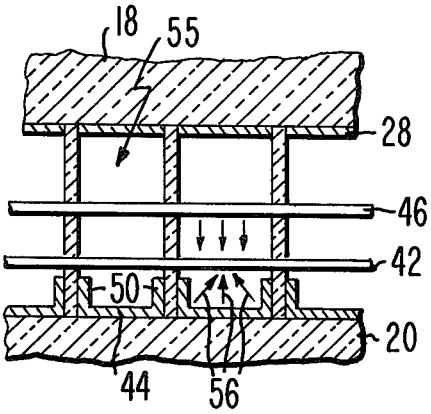

FIG. 5 is a sectional view similar to FIG. 4 of a second form of the beam guide which can be used in the display device of FIG. 1.

Figure 6:
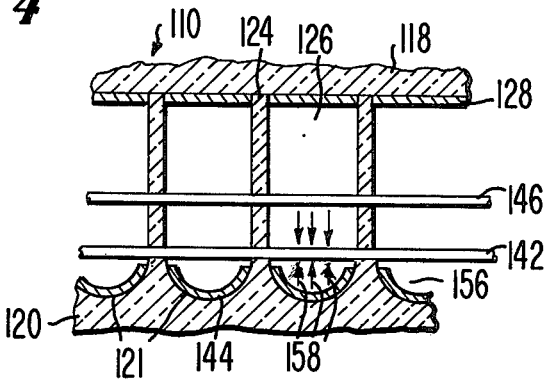

FIG. 6 is a sectional view similar to FIG. 4 of a third form of the beam guide which can be used in the display device of FIG. 1.

Figure 7:
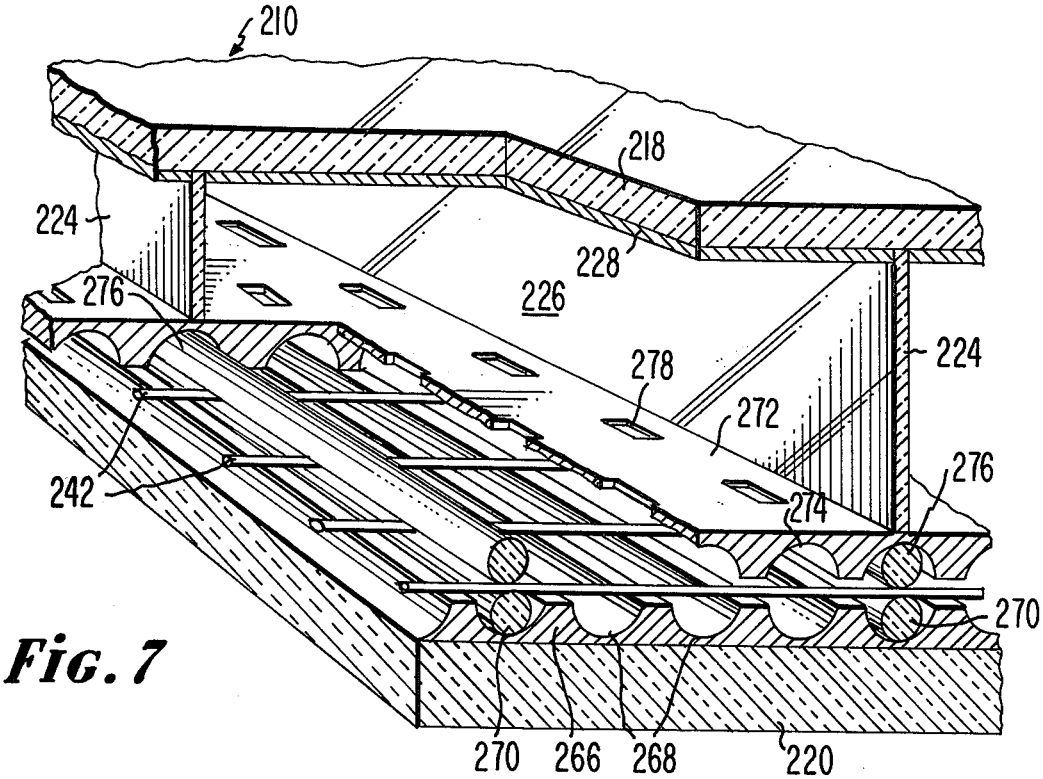

FIG. 7 is a sectional perspective view of a fourth form of the beam guide which can be used in the display device of FIG. 1.

Figure 8:
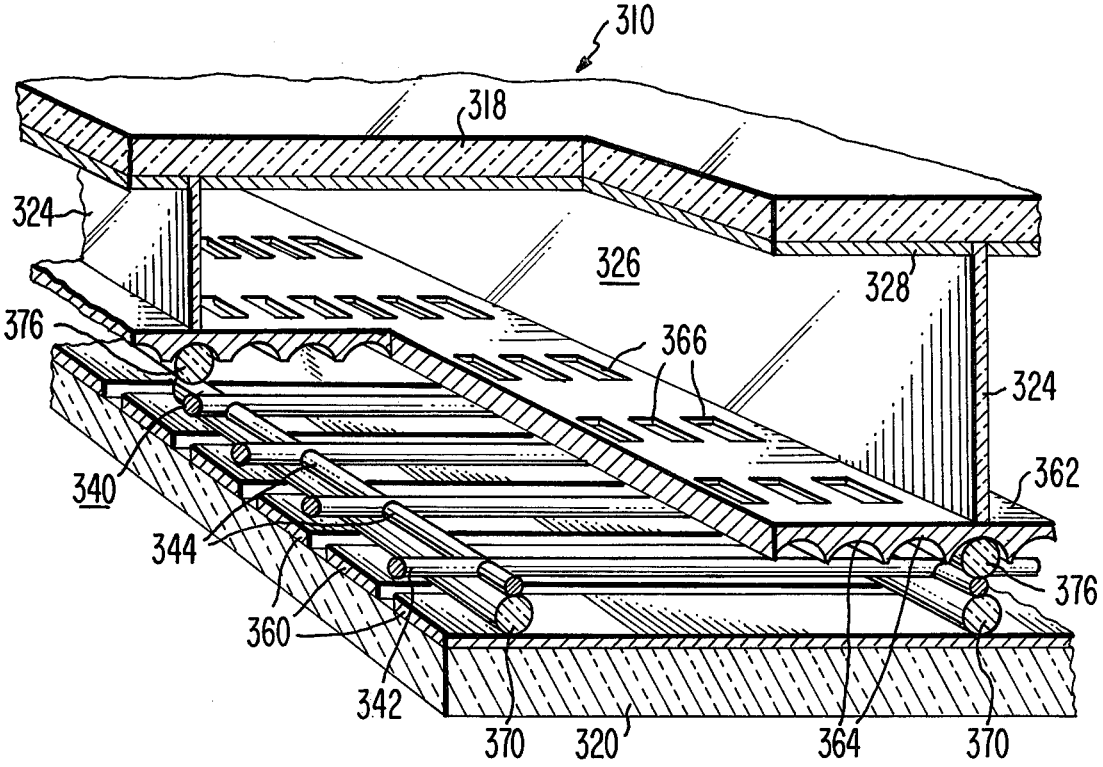

FIG. 8 is a sectional perspective view of a fifth form of the beam guide which can be used in the display device of FIG. 1.

DETAILED DESCRIPTION

Referring to FIG. 1, a flat display device including the beam guide of the present invention is generally designated as 10. The display device 10 comprises an evacuated envelope 12, typically of glass, having a display section 14 and an electron gun section 16. The display section 14 includes a rectangular front wall 18, and a rectangular back wall 20 in spaced parallel relation with the front wall 18. The front wall 18 and back wall 20 are connected by side walls 22. The front wall 18 and back wall 20 are dimensioned to correspond with the size of the viewing screen desired, e.g., about 75 cm by 100 cm and are spaced apart typically about 2.5 to 7.5 cm.

A plurality of spaced, substantially parallel, vertically extending supporting walls 24 are secured between the front wall 18 and the back wall 20. The supporting walls 24 provide the internal support for the evacuated envelope 12 against external atmospheric pressure, and divide the display section 14 into a plurality of vertically extending channels 26. In each of the channels 26 is a beam guide. On the inner surface of the front wall 18 is a phosphor screen 28.

The gun section 16 is an extension of the display section 14 and extends along one set of adjacent ends of the channels 26. The gun section may be of any shape suitable to enclose the particular gun structure contained therein. The electron gun structure contained in the gun section 16 may be of any well-known construction suitable for selectively directing a beam of electrons along each of the channels 26. For example, the gun structure may comprise a plurality of individual guns, one being mounted at one end of each of the channels 26 for directing separate beams of electrons along each of the channels.

Alternatively, the gun structure may be a single gun at one end of the gun section 16 which directs an electron beam across the ends of the channels 26 with deflection electrodes being provided along the gun section 16 for selectively deflecting the electron beam into each of the channels 26. One such gun structure is shown in the previously referred to U.S. Pat. No. 2,928,014.

Another type of gun structure which can be used includes a line cathode extending along the gun section 16 across the ends of the channels 26 and adapted to selectively direct individual beams of electrons along the channels. A gun structure of this type is described in U.S. Pat. No. 2,858,464 to W. L. Roberts, issued Oct. 28, 1958, entitled "Cathode Ray Tube."

A terminal 27 extends through a side wall 22 of the envelope 12. The terminal 27 includes a plurality of terminal wires by which the gun structure and other parts of the display within the envelope 12 can be electrically connected to suitable operating circuitry and power source outside of the envelope 12.

A beam guide is disposed in each of the channels 26, and utilizes the technique of slalom focusing which is described in the article entitled, "Slalom Focusing," by J. S. Cook et al, *Proceedings of the IRE*, Vol. 45, November 1957, pages 1517–1522. Slalom focusing, as there described, makes use of a plurality of spaced, parallel wires or rods arranged in a common plane midway between two parallel plates. The wires or rods are charged positively with respect to the plates. The electrostatic field thereby created is such that when a beam of electrons is directed into the space between the plates along the plane of the rods or wires, the beam will weave an undulating path through the array of rods or wires. While such a structure adequately provides for confining the beam along its intended path, it does not provide for extraction of the beam from the structure at selected points as is required in the present invention.

Figure 2A:
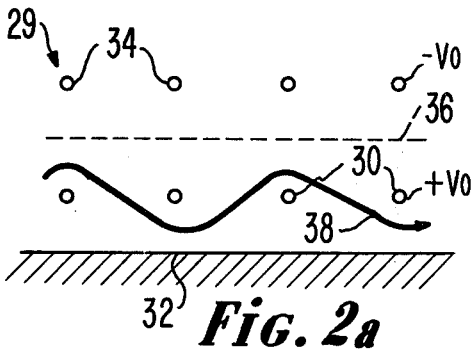

Referring to FIG. 2*a*, there is shown schematically in simplified form one form of the beam guide which is generally designated as 29 which can be used in the display device 10 to provide focusing and selective deflection of the electron beam. The beam guide 29 comprises a first set of spaced, parallel wires 30 arranged in a common plane between a ground plane 32 and a second set of spaced, parallel wires 34 arranged in a common plane parallel to the ground plane 32. The first set of wires 30 is positioned closer to the ground plane 32 than to the second set of wires 34. The second set of wires 34 contains the same number of wires as contained in the first set of wires 30, and each of the wires 34 is directly over and parallel to a different one of the wires 30. In the operation of this form of the beam guide, a potential $+V_O$ which is positive with respect to the ground plane 32 is applied to each of the wires 30 of the first set, and an equal but negative potential $-V_O$ is applied to each of the wires 34 of the second set. This creates a zero volt plane, indicated by the dashed line 36, between the two sets of wires and parallel to the ground plane 32. Thus as in the article of Cook et al, a beam of electrons directed into the beam guide will follow an undulating path weaving itself through the first set of wires 30 as indicated by the arrow-headed line 38.

Figure 2B:
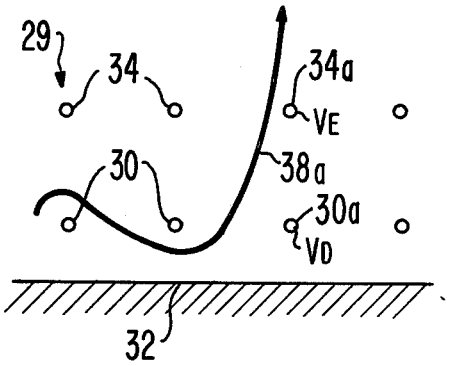

As shown in FIG. 2b, to extract the electron beam from the beam guide 29, a wire 30a of the first set of wires 30 is switched to a low DC potential, $V_D$, which is less than $+V_O$ and the corresponding wire 34a of the second set of wires 34 is switched to a positive DC potential, $V_E$. This changes the electrostatic field so that the beam is deflected away from the ground plane 32 and out of the beam guide 29 between two wires of the second set of wires 34 as shown by the line 38a. Thus, by switching the potentials applied to the various pairs of adjacent wires of the two sets of wires 30 and 34, the electron beam can be deflected out of the beam guide 29 at selected points along the beam guide.

Figure 3A:
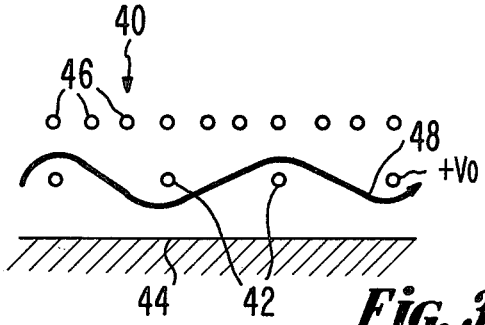

Referring to FIG. 3*a*, another form of the beam guide which can be used in the display device 10 is generally designated as 40. The beam guide 40 like the beam guide 29 shown in FIG. 2*a*, includes a first set of spaced, parallel wires 42 arranged in a plane between a ground plane 44 and a second set of spaced, parallel wires 46 lying in a common plane parallel to the ground plane 44. However, in the beam guide 40, the number of wires 46 in the second set is greater than the number of wires 42 in the first set, and the first set of wires 42 are positioned midway between the ground plane 44 and the second set of wires 46.

In the operation of the beam guide 40, each of the wires 42 of the first set is at a potential $+V_O$ which is positive with respect to the ground plane 44 and both the ground plane 44 and the second set of wires 46 are at zero potential. This creates an electrostatic field such that when an electron beam is directed into the beam guide, the electron beam will follow an undulating path through the array of the first set of wires 42 as indicated by the arrowheaded line 48.

Figure 3B:
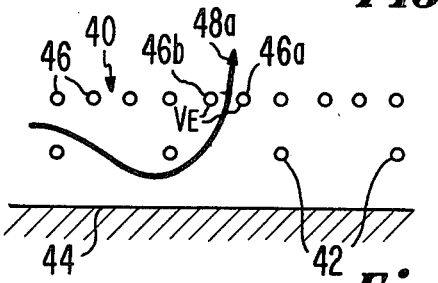

To extract the electron beam from the beam guide 40, two adjacent wires 46a and 46b of the second set of wires 46 are switched to a positive DC potential $V_E$ which is approximately equal to $+V_O$ as indicated in FIG. 3*b*. This causes the electron beam to be deflected toward the second set of wires 46. The beam passes between the two positively charged wires 46*a* and 46*b* as indicated by the line 48*a* in FIG. 3*b* and out of the beam guide 40. Thus, by switching various pairs of adjacent wires of the second set of wires 46 to a positive potential, the electron beam can be deflected out of the beam guide 40 at selected points along the beam guide.

Figure 3C:
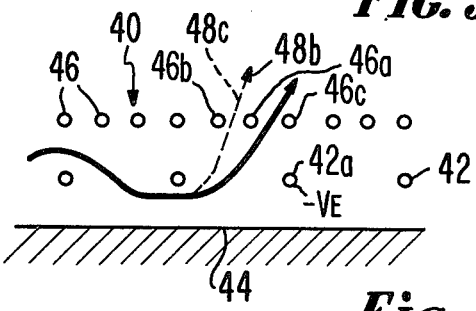

FIG. 3*c* illustrates an alternate manner of operating the beam guide 40 to selectively extract the electron beam. In this manner of operation, one of the wires 42*a* of the first set is switched to a negative voltage $-V_E$, which is not as negative as $-V_O$. This changes the electrostatic field applied to the electron beam so as to deflect the beam toward the second set of wires 46. The electron beam then passes out of the beam guide 40 between two of the wires 46*c* and 46*a* of the second set of wires 46 as indicated by the solid line 48*b*. If the one wire 42*a* of the first set is switched to a potential more negative than $-V_E$ the electrostatic force applied to the beam causes the beam to deflect further away from the wire 42*a*. This will cause the electron beam to pass out of the beam guide 40 between two different wires 46*a* and 46*b* of the second set as indicated by the dashed line 48*c*. Therefore, by varying the magnitude of the negative potential applied to the wires 42 of the first set, the electron beam can be deflected by different amounts to extract the beam from the beam guide 40 at various selected positions between different parts of adjacent wires 46 which are positioned between adjacent wires 42 of the first set of wires. Thus, this manner of operating the beam guide 40 permits extracting the electron beam at a greater number of positions than can be achieved with the beam guide 29 of FIG. 2 or the manner of operation shown in FIG. 3*b*.

Referring to FIG. 4, there is shown a section of the beam guide 40 of FIG. 3 in the display device 10 of the present invention. Since the electron beam must pass along each of the channels 26, the beam guide must also include means for confining the beam in the channel 26 to prevent the support walls 24 from interfering with the flow of the electron beam. In each of the channels 26 of the display device 10, the ground plane 44 of the beam guide is a film of an electrically conductive metal on the inner surface of the back wall 20 of the envelope 12. The wires 42 of the first set of wires extend through and are supported by the support walls 24 with each of the wires 42 extending across all of the channels 26. The wires 42 are in spaced relation along the length of the channels 26 and are all in a common plane parallel to the back wall 20. The wires 46 of the second set of wires also extends through and are supported by the support walls 24 with each of the wires 46 extending across all of the channels 26. The wires 46 are in spaced relation along the length of the channels 26, and are in a common plane between the first set of wires 42 and the front wall 18. In each of the channels 26, a first pair of metal film confinement electrodes 50 are on the support wall 24 between the ground plane 44 and the first set of wires 42. The first pair of confinement electrodes 50 extend to the ground plane 44 so as to be electrically connected thereto, but are spaced from the first set of wires 42. A second pair of metal film confinement electrodes 52 are on the support walls 24 between the first set of wires 42 and the second set of wires 46. The second pair of confinement electrodes 52 are spaced from both sets of wires 42 and 46. Both the electrodes 50 and 52 are continuous strips extending the entire length of the channels.

In the operation of the display device 10, each of the second set of wires 46, the ground planes 44, the first pair of confinement electrodes 50 and the second pair of confinement electrodes 52 are at zero potential and each of the first set of wires 42 is at a potential ($+V_O$) which is positive with respect to the ground planes 44. Thus, the electron beam directed along each of the channels 26 from the gun section 16 of the device 10 will follow an undulating path through the array of the first set of wires 42 as previously described with regard to the beam guide 40 shown in FIG. 3. The electric fields created between the wires 42 and the confinement electrodes 50 and 52 apply electrostatic forces to the electrons of the electron beam in the direction indicated by the arrows 54 in FIG. 4 so as to force the electrons toward the central portion of the channel 26. This confines the beam to the central portion of the channel 26 and thereby prevents the support walls 24 from interfering with the beam. By making the potential applied to two adjacent wires 46 of the second set of wires more positive as shown and described with regard to FIG. 3*b* or by switching one of the wires 42 of the first set to a negative potential as shown and described with regard to FIG. 3*c*, the electron beam will be deflected away from ground plane 44 and will pass out of the beam guide toward the front wall 18 and will impinge on the phosphor screen 28 which is at a positive potential with respect to the gun structure. Thus, with the beam guide of the present invention, a confined electron beam can be provided along each of the channels 26 and the beam can be deflected toward the phosphor screen 28 at various selected points along the length of the channels 26. By providing an electron beam or electron beams along the channels 26 and by varying the points of deflection of the beams, horizontal and vertical scanning of the phosphor screen 28 can be achieved to provide a display on the front wall 18 of the display device 10.

A specific example of a beam guide 40 can use wires 42 and 46 which are 0.15 mm in diameter. The wires 42 of the first set of wires can be spaced apart a distance of 1.5 mm and the wires 46 of the second set of wires can be spaced apart a distance of 0.5 mm. The second set of wires 46 can be spaced from the ground plane 44 a distance of 1.5 mm. With the second set of wires 46, the ground plane 44 and the confinement electrodes being at zero potential, the first set of wires 42 being at a potential of +300 volts and the cathode of the gun structure being at −30 volts, an electron beam directed into the guide 40 will follow an undulating path through the array of the first set of wires 42. The beam can be extracted from the beam guide 40 by either switching two adjacent wires 46 of the second set of wires to a potential of approximately +300 volts or by switching one of the first set of wires 42 to a potential of approximately −100 volts.

Referring to FIG. 5 there is shown a beam guide 55 which is a modified form of the beam guide 40 of FIG. 4. The beam guide 55 in each of the channels 26 is the same as that shown in FIG. 4 except that only the first set of confinement electrodes 50 are provided on the support walls 24. In the operation of this form of the beam guide, the forces created by the electric fields between the first set of wires 42 and the confinement electrodes 50 and ground plane 44 which confine the electron beam to the center portion of the channel 26 are applied to the electron beam only during the time that the electron beam passes between the first set of wires 42 and the ground plane 44 as indicated by the arrows 56. However, since these confinement forces are being applied to the electron beam during about one half of the length of its travel along the channel 26, it is sufficient to maintain the electron beam away from the support walls 24.

Referring to FIG. 6, a modification of the display device of the present invention is generally designated as 110. Display device 110 is of a structure similar to the display device 10 shown in FIG. 1 except that the inner surface of the back wall 120 has a plurality of parallel grooves 121 therein with the grooves being of arcuate cross section e.g. semicircular. The support walls 124 which are secured between the front wall 118 and the back wall 120 are positioned along the ridges between the grooves 121 so that each of the grooves extends along a separate one of the channels 126. The first set of wires 142 extend through the support walls 124 at the junction of the support walls 124 and the back wall 120. Metal film ground planes 144 are on the surfaces of the grooves 121 so that each of the ground planes 144 is substantially U-shaped with the ends of the ground plane 144 being spaced from the first set of wires 142. The second set of wires 146 extend through the support walls 124 between the first set of wires 142 and the front wall 118. A phosphor screen 128 is on the inner surface of the front wall 118.

The display device 110 operates in the same manner as previously described with regard to the display device 10 shown in FIG. 4. However, the electric fields created between the U-shaped ground planes 144 and the wires 142 create electrostatic forces as indicated by the arrows 158 so that when the electron beam passes between the first set of wires 142 and the ground plane 144 the beam is confined to the central portion of the channel 126. Thus, confinement forces are applied to the electron beam during about one half of its length of travel along the channel 126 in a manner similar to that of the form of the beam guide shown in FIG. 5 but without the need of confinement electrodes on the support walls 124.

Referring to FIG. 7, a display device having another form of the beam guide of the present invention is generally designated as 210. The display device 210 includes front and back walls 218 and 220, respectively, and spaced support walls 224 extending between the front and back walls and forming a plurality of channels 226. A first metal ground plate 266 is disposed on the inner surface of the back wall 220. The first ground plate 266 has a plurality of spaced, substantially parallel grooves 268 in its surface which faces the front wall 218. Each of the grooves 268 is arcuate, e.g. semicircular, in cross section and extends in the same direction as the channels 226 between the support walls 224. Elongated spacer rods 270 of an electrical insulating material, such as glass, are in spaced ones of the grooves 268 with at least one groove 268 being between each pair of adjacent spacer rods 270. The spacer rods 270 are of a diameter slightly greater than the depth of the grooves 268 so that the spacer rods project slightly out of the grooves 268. A set of spaced, parallel wires 242 extend across and engage the spacer rods 270. Since the spacer rods 270 project beyond the grooves 268, the wires 242 are spaced from the first ground plate 266.

A second metal ground plate 272 is parallel to the first metal ground plate 266 but on the side of the set of wires 242 toward the front wall 218. The second ground plate 272 has a plurality of spaced, parallel grooves 274 in its surface facing the first ground plate 266. The grooves 274 are arcute, e.g. semicircular, in cross section and are mutually coextensive in length and face corresponding grooves 268 in the first ground plate 266. Elongated spacer rods 276 of an electrical insulating material, such as glass, are disposed in the grooves 274 which mate with the grooves 268 containing the spacer rods 270. The spacer rods 276 are of a diameter slightly greater than the depth of the grooves 274 so as to project slightly out of the grooves 274. The spacer rods 276 engage the set of wires 242 so as to space the second ground plate 272 from the wires 242.

The second ground plate 272 has a plurality of openings 278 therethrough. The openings are arranged in aligned rows along the bottoms of the grooves 274. Each of the openings 278 is elongated along the length of the grooves 274 and is positioned in a space between the wires 242. The support walls 224 extend between the front wall 218 and the second ground plate 272 and are positioned along the grooves of the ground plate which contain the spacer rods 270 and 276 so as to provide mechanical support between the front wall 218 and the back wall 220. Although the display device 210 is shown having three pairs of mating grooves 268 and 274 along each of the channels 226 between the support walls 224, the support walls 224 can be either closer together or further apart to provide any desired number of the mating grooves along each of the channels. A phosphor screen 228 is on the inner surface of the front wall 218 in each of the channels 226.

In the operation of the display device 210, each of the ground plates 266 and 272 are at zero potential, and the wires 242 are at a positive potential. Thus, an electron beam which is directed into each pair of mating grooves 268 and 274 will follow an undulating path along the array of the wires 242. The arcuate shape of the grooves 268 and 274 creates an electrostatic field which confines the beam to substantially the center line of the grooves in the manner described with regard to the beam guide shown in FIG. 6 but with the confinement forces being applied along the entire undulating path of the beam. By switching selected ones of the wires 242 to a negative potential, the electron beam will be deflected toward the second ground plate 272 and will pass out of the beam guide through one of the openings 278 in the manner described with regard to the manner of operation shown in FIG. 3*c*. Since the openings 278 are elongated, by varying the magnitude of the potential applied to the respective wire 242, the angle of deflection can be varied so that the electron beam will impinge on the phosphor screen 228 at various points.

Referring to FIG. 8, a display device having still another form of the beam guide of the present invention is generally designated as 310. The display device 310 includes front and back walls 318 and 320, respectively, and spaced support walls 324 extending between the front and back walls and forming a plurality of channels 326. A phosphor screen 328 is on the inner surface of the front wall 318.

A plurality of spaced, parallel electrical conductors 360, each in the form of a metal film strip, are on the inner surface of the back wall 320. The conductors 360 extend transversely across all of the channels 326. As will be explained, the conductors 360 serve as one ground plane and as the electrodes for deflecting the electron beams out of the guide.

A metal ground plate 362 extends transversely across all of the channels 326 spaced from and substantially parallel to the conductors 360. The ground plate 362 also extends the full length of the channels 326. The ground plate 362 has a plurality of substantially parallel grooves 364 in its surface which faces the conductor 360. Each of the grooves 364 is arcuate, e.g. semicircular, in cross section and extends longitudinally along the channels 326. As shown, there are six grooves 364 in each of the channels 326. The ground plate 362 has a plurality of openings 366 therethrough. The openings 366 are arranged in aligned rows along the bottoms of the grooves 362.

A grid 340 is mounted between and substantially parallel to the conductors 360 and the ground plate 362. The grid 340 includes a plurality of spaced, parallel wires 342 which extend transversely across the channels 326 with each of the wires 342 extending along a separate one of the conductors 360. The wires 342 are connected by spaced, parallel sets of aligned connecting portions 344. Each aligned set of the connecting portions 344 extends along and parallel to the groove 364 in the ground plate 362. The openings 366 on the ground plate 362 are positioned between the wires 342 of the grid 340.

The grid 340 is retained in spaced relation to the back wall 320 by elongated spacer rods 370 of an electrical insulating material, such as glass. Each of the spacer rods 370 extends along a set of the aligned connecting portions 344 of the grid 340. The ground plate 362 is retained in spaced relation to the grid 340 by elongated spacer rods 376 of an electrical insulating material, such as glass. Each of the spacer rods 376 extends along a set of the aligned connecting portions 344 of the grid 340 and fits within the adjacent groove 364 in the ground plate 362. The spacer rods 376 are of a diameter greater than the depth of the grooves 364 so as to space the ground plate 362 from the grid 340. The support walls 324 extend between the front wall 318 and the ground plate 362 and are positioned along the grooves 364 in the ground plate 362 which contain the spacer rods 376. Thus, the spacer rods 370 and 376, the sets of aligned connecting portions 344 of the grid 340, the ground plate 362 and the support walls 324 provide mechanical support between the front wall 318 and the back wall 320.

In the operation of the display device 310, a positive potential is applied to each of the wires 342 of the grid 340, and zero potential is applied to each of the conductors 360 and the ground plate 362. Thus, the conductors 360 form a second ground plate on the side of the wires 342 opposite the ground plate 362. A separate electron beam is directed between the ground planes formed by the conductors 360 and the ground plate 362 at each of the grooves 364 in the ground plate 362. The electron beams will each follow an undulating path along the array of the wires 342 along its respective groove 364. The arcuate shape of each of the grooves 364 creates an electrostatic field which confines its respective beam to substantially the center line of the groove in the manner described with regard to the beam guide shown in FIG. 6 but with the confinement forces being applies to the beam as the beam passes between the grid 340 and the ground plate 362.

By switching the potential applied to one of the conductors 360 to a negative potential, the electrostatic forces applied to the beam as it passes between the switched conductor and the adjacent wire 342 will cause the beam to be deflected out of its undulating path away from the negative potential conductor. The deflected beam will then pass through the next opening 366 in the ground plate 362 and will impinge on the phosphor screen 362. Thus, by switching the conductors 360 in sequence to a negative potential, the beams in the channels 326 can be deflected at various points along the channels 326 to achieve a scanning of the phosphor screen 328.

In the forms of the beam guide of the present invention shown in FIGS. 4, 5 and 6, the second set of wires may either include the same number of wires as in the first set so as to operate in the manner described with regard to FIG. 2 or may include a greater number of wires than in the first set so as to operate in the manner described with regard to FIG. 3. Also, in the forms of the beam guide shown in FIGS. 4, 5 and 6, where the beam guide is operated with the second set of wires being at a constant potential and the deflection of the beam being achieved by changing the potential applied to the wires of the first set, the second set of wires may be replaced by either a metal plate having a plurality of openings therethrough or by a wire mesh screen. In the form of the beam guide shown in FIG. 8, the ground plate 362 can be replaced by a second set of wires such as used in the beam guides shown in FIGS. 4, 5 and 6. Although the display device of the present has been shown as having a rectangular front wall, the front wall can be of any desired shape. Also, although the display device has been described with the gun section extending across one end of the channels, there can be a sectional gun section across the other ends of the channels so that electron beams are directed into some of the channels at one end and onto other channels at the opposite end.

Thus, there is provided by the present invention a flat display device which can be made large in size with support within the evacuated envelope to prevent collapse of the envelope. The supports are arranged to form channels which extend across the front wall of the envelope. Electron beams are directed into the channels and beam guides, which utilize slalom focusing, are provided in the channels to guide the beams along the channels. The beam guides also confine the electrons of the beam to maintain the cross-sectional dimension of the beam and provide for deflecting the beam at various points along the length of the channel toward the phosphor screen of the display device.

I claim:

1. An electron display device comprising:

an evacuated envelope having a front wall, a phosphor screen on the inner surface of said front wall, means in said device for generating a beam of electrons and directing said beam in a path generally parallel to and across said front wall, and means along said beam path for causing said beam to travel in a substantially confined undulating path with the undulations thereof toward and away from said screen, and for selectively deflecting said beam out of said path toward said phosphor screen at selected points along said path.

2. An electron display device in accordance with claim 1 in which the means for causing the beam to travel in an undulating path includes a set of spaced, parallel electrical conductors substantially parallel to said front wall, and means forming ground planes on each side of said conductors with said ground planes being spaced from and substantially parallel to said conductors.

3. An electron display device in accordance with claim 2 in which the means forming the ground plane on the side of the set of conductors toward the phosphor screen has a plurality of spaced openings through which the electron beam can pass when the beam is deflected.

4. An electron display device in accordance with claim 3 in which the means forming the ground plane on the side of the set of conductors toward the phosphor screen comprises a second set of spaced, parallel, electrical conductors. separate one

5. An electron display device in accordance with claim 4 in which the number of conductors in the second set of conductors is equal to the number of conductors in the first set, and each of the conductors in the second set is directly over and parallel to a separateone of the conductors in the first set.

6. An electron display device in accordance with claim 4 in which the number of conductors in the second set of conductors is greater than the number of conductors in said first set.

7. An electron display device in accordance with claim 3 in which the means forming the ground plane on the side of the set of wires toward the phosphor screen is a metallic plate having a plurality of spaced openings therethrough.

8. An electron display device comprising:

an evacuated envelope having closely spaced, substantially parallel, front and back walls, and a plurality of spaced, substantially parallel support walls extending substantially perpendicularly between said front and back walls and forming a plurality of channels extending across said front and back walls, a phosphor screen along the inner surface of said front wall in each of said channels, means at one end of said channels for generating and directing electrons along each of said channels, and means along each of said channels for causing said electrons to travel as beams of electrons in substantially confined undulating paths but permitting said beams to be deflected out of said paths toward said phosphor screen at selected points along said paths.

9. An electron display device in accordance with claim 8 in which the means for causing the beam to travel in an undulating path includes a set of spaced, parallel wires substantially parallel to the walls of said device and extending across said channels, means for forming a first ground plane substantially parallel to and spaced from said set of wires between said set of wires and the back wall and means for forming a second ground plane substantially parallel to and spaced from said set of wires between said set of wires and the front wall.

10. An electron display device in accordance with claim 9 in which the means forming the second ground plane has a plurality of spaced openings through which the electron beams can pass when the beams are deflected.

11. An electron display device in accordance with claim 10 in which said means forming the first ground plane includes a metal member extending along the inner surface of the back wall.

12. An electron display device in accordance with claim 11 in which said back wall is an insulator and the metal member comprises a metal film on the inner surface of the back wall along each of the channels.

13. An electron display device in accordance with claim 12 in which said wires extend through the support walls at points spaced from the back wall.

14. An electron display device in accordance with claim 11 including a plurality of elongated rods of electrical insulating material, each of said rods being on and extending along the metal plate parallel to said support walls, with said wires extending across and being supported on said rods.

15. An electron display device in accordance with claim 14 in which the means for forming said second ground plane comprises a second metal plate parallel to said first metal plate forming said first ground plane.

16. An electron display device in accordance with claim 15 including a separate, elongated rod of an electrical insulating material between the second metal plate and the wires along each of said rods which is between the wires and the first metal plate so as to space the second plate from the wires.

17. An electron display device in accordance with claim 16 in which said second plate has a plurality of openings therethrough which are positioned over the spaces between the wires.

18. An electron display device in accordance with claim 17 in which the support walls are positioned along the insulating rods.

19. An electron display device in accordance with claim 11 in which the means forming said second ground plane comprises a second set of spaced, parallel wires extending through the support walls and across the channels.

20. An electron display device in accordance with claim 19 in which the number of wires in the second set of wires is equal to the number of wires in said first set of wires and each of the wires in said second set is over and parallel to a separate one of the wires in said first set of wires.

21. An electron display device in accordance with claim 19 in which the number or wires in said second set is greater than the number of wires in said first set of wires.

22. An electron display device in accordance with claim 11 in which the means forming the first ground plane comprises a plurality of spaced, parallel conductors on the inner surface of the back wall extending transversely across the channels substantially parallel to said wires.

23. An electron display device in accordance with claim 22 in which the back wall is an insulator and the conductors are metal film strips on the back wall.

24. An electron display device in accordance with claim 23 in which the means forming the second ground plate comprises a metal plate parallel to the back wall, said metal plate having a plurality of openings therethrough with said openings being arranged in rows along the channels and being positioned between said wires.

25. An electron display device in accordance with claim 24 including means spacing the wires from the conductors and the metal plate from the wires.

26. An electron display device in accordance with claim 25 in which the means spacing the wires from the conductors comprises a plurality of spaced rods of electrical insulating material extending along said channels between the wires and the conductors and the means spacing the metal plates from the wires comprises a plurality of spaced rods of electrical insulating material extending along said channels between said metal plate and the wires.

27. An electron display device in accordance with claim 26 in which each of the rods between the wires and conductors extends along a separate one of the rods between the wires and the metal plate and each of the support walls extends along a separate one of the rods between the wires and the metal plates.

28. An electron display device comprising:

an evacuated envelope having a front wall, a phosphor screen on the inner surface of said front wall, means in said device for generating a beam of electrons and directing said beam in a path generally parallel to and across said front wall, and means along said beam path creating an electrostating field which causes said beam to follow a substantially confined undulating path with the undulations thereof toward and away from said screen, and for selectively deflecting said beam out of said path toward said phosphor screen at selected points along said path.

29. An electron display device comprising:

an evacuated envelope having closely spaced, substantially parallel front and back walls, and a plurality of spaced, substantially parallel support walls extending substantially perpendicularly between said front and back walls and forming a plurality of channels extending across said front and back walls, a phosphor screen along the inner surface of said front wall in each of said channels, means at one end of said channels for generating and directing electrons along each of said channels, and means along each of said channels creating an electrostatic field which causes said electrons to travel as beams in substantially confined undulating paths but permitting said beams to be deflected out of said paths toward said phosphor screen at selected points along said paths.

* * * * *